United States Patent [19]

Achelpohl et al.

[11] 4,063,693

[45] Dec. 20, 1977

[54] APPARATUS FOR STORING ARTICLES DISCHARGED AT A HIGH RATE FROM PRODUCTION MACHINES

[75] Inventors: Fritz Achelpohl; Richard Feldkamper, both of Lengerich, Germany

[73] Assignee: Windmoller & Holscher, Lengerich, Germany

[21] Appl. No.: 728,843

[22] Filed: Oct. 1, 1976

[30] Foreign Application Priority Data

Oct. 2, 1975 Germany ..... 2544135

[51] Int. Cl.[2] ..... B65H 17/02; B65B 63/04

[52] U.S. Cl. ..... 242/67.1 R; 53/118

[58] Field of Search ..... 242/67.1 R, 75.1, 55, 242/62, 54 R, 81; 53/118, 198 R; 93/8 R

[56] References Cited

U.S. PATENT DOCUMENTS

| | | | |
|---|---|---|---|
| 402,551 | 4/1889 | Winn | 242/62 |
| 2,984,429 | 5/1961 | Huck | 242/75.1 |
| 3,315,908 | 4/1967 | Wetzler | 242/67.1 R |
| 3,964,235 | 6/1976 | Miller | 53/118 |

*Primary Examiner*—Edward J. McCarthy
*Attorney, Agent, or Firm*—Fleit & Jacobson

[57] ABSTRACT

An apparatus for storing flat articles comprises a first conveyor, two deflectors for diverting the articles fro the first conveyor to a second slower conveyor disposed beneath each deflector at right-angles to the first conveyor for receiving the articles in an overlapping formation, a frame adjoining the second conveyor and carrying rollers at each end, endless driven conveyor belts passing over the rollers, the frame being pivotable about the axis of one of the rollers so that the other roller is disposed adjacent to a winding for receiving covolutions of the overlapping formation of articles and so that the belts are in contact with the convolutions to turn the core, and a supply reel of holding tape associated with each winding core.

7 Claims, 3 Drawing Figures

APPARATUS FOR STORING ARTICLES DISCHARGED AT A HIGH RATE FROM PRODUCTION MACHINES

The invention relates to an apparatus for storing sacks, bags or like flat articles discharged at a high rate from production machines, comprising a conveyor for feeding the articles to a station which combines them to form units containing larger numbers.

In modern high-capacity sack-making machines, the stacking, palletizing and combination of the manufactured sacks to form transportable units present a special problem. Numerous apparatuses for forming edge-aligned stacks from sacks or bags are known, in which the articles individually supplied at high speed or the articles separated from an overlapping band are superpositioned in front of an abutment to form edge-aligned stacks. Further, it is known in the case of articles coming from a production machine and deposited in overlapping relationship on a conveyor belf for further transport to push the articles together in sections and stack them with the edges aligned. In all known stack-forming devices, there is not only the problem that the flow of articles that are constantly supplied by the production machine must be interrupted for short periods because the formation and discharge of the stacks of articles can only take place intermittently so that the flow of articles must be stowed up or diverted to a further stack-forming station, but the individual stacks must be subsequently also be stacked on palletes by hand or tied up into bundles of stacks. Collecting the individual stacks to form larger units suitable for dispatch involves labour charges and additional operating personnel is again required when unloading and separating the stacks. Although depositing equipment for sacks stacked on palletes already exists, this must still be supervised by operating personnel, thereby resulting in labour costs in addition to the capital expenditure for the machinery.

Particular difficulties can arise when superposed sacks forming edge-aligned stacks have to be separated for filling purposes. In an apparatus known from U.S. Pat. No. 3,691,715 for separating valved sacks and feeding them to filling machines, stacks of valved sacks are at one side filled into a magazine to stand on their edges. A pivotable gripper provided with suction cups withdraws the foremost sack from the magazine and introduces it into holding tongs whilst turning it through 90°, the tongs then conveying the sack to the filling nipple of the filling machine whilst the valve is opened. By reason of static charging or adhesion, however, the sacks in the stack magazine can adhere to one another so intensively that the grippers remove more than one sack from the magazine, this resulting in disturbances and interruptions in operation. Plastic sacks are particularly difficult to separate from a stack because of their smooth surface and low stiffness against bending. Storing of the valved sacks to be filled in stacks in magazines can also result in the sacks becoming so deformed that they cannot be properly grasped and the valves cannot be properly opened, thereby possibly giving rise to interruptions during the filling operation and loss of filling material and sack material.

It is therfore an object of the invention to provide an apparatus with which sacks discharged at a high rate from the base-forming device of a sack machine can be automatically packaged in such a way that they can subsequently be separated again in a simple manner, for example for the purpose of filling them.

According to the invention, this object is achieved in an apparatus of the aforementioned kind in that the conveyor is provided with at least two deflectors which are disposed behind one another in the conveying direction and below each of which there is disposed at right-angles a slower further conveyor that is provided with a lateral abutment near each deflector and that adjoins a frame carrying rollers at least at opposite ends and pivotable about the axis of the first roller, that endless driven conveyor belts pass over the rollers and each frame can be so applied to a winding core mounted in the machine stand between two freely rotatable mandrels to form overlapping band reels from the articles supplied in overlapping formation by the further conveyors that the endless belts drive the overlapping band reel, and that in the stand of each further conveyor there are mounted at least two rollers with holding tapes which are passed over guide rollers, extend beneath the articles guided on the frame and the leading ends of which are secured on the winding core. The invention is based on the consideration that the hitherto predominant practice of collecting into edge-aligned stacks the sacks deposited on a conveyor belt in overlapping relationship by the sack-making machine requires constructionally complicated apparatuses and is not desirable anyway because of the difficulty of separating the sacks from edge-aligned stacks. Since sacks superposed in overlapping relationship can be positively grasped individually for the purpose of separation, the invention is based on the recognition that it is more desirable and simple to deposit the manufactured sacks in superposed overlapping relationship and to form from these overlapping bands overlapping storage band reels rather than stacking the sacks discharged at high speed from the production machine or pushing the overlapping deposited sacks together to form edge-aligned stacks. The invention suggests an apparatus by means of which the sacks discharged at a high rate from a production machine can be wound in a simple manner to form storage reels that are not only simple to transport and handle but from which the sacks can also be simply separated for the purpose of their subsequent filling.

By means of the apparatus according to the invention, the sacks discharged, for example, in a transverse position from the base-forming device are conveyed by the conveyor up to the first deflector disposed therein and deflected thereby onto the conveyor that is disposed therebeneath at an angle of 90°. By transfer to the further conveyor, the articles are now advanced in the longitudinal direction and reach the adjoining winding device on which they are wound to form a storage reel. As soon as the storage reel has reached the predetermined number of sacks, the holding tapes that are wound up together with the sacks are slung about the storage reel several more times and fastened thereto. The wound reel is then removed from the winding station and a new winding core is inserted and prepared for the next coiling operation. During the time in which these concluding and preparatory steps are carried, the articles are, by switching over the deflectors, fed over the first transporting device towards a second transporting device which extends at right-angles to the first transporting device and in which the articles are wound in the described manner in a second winding device to form a storage reel. By means of the apparatus according to the invention, uninterrupted operation of the high-capacity sack-making machine is ensured and the discharged sacks are so packaged that they can be readily separated again for filling.

The apparatus of the invention consists of a combination of features that are partially known per se.

Thus, it is for example known to coil bands of superposed overlapping flat articles to form storage reels. From DT-OS 2 307 728 it is known to supply, by way of different conveying paths and deflectors that connect same, a plurality of stitching apparatuses with tube sections discharged at a high rate from a tube machine and to collect at a packaging station and stack on a pallet the excess tube sections that are not processed by the stitching apparatuses.

In a further development of the invention, the endless bands passing over the pivotable frames are guided over conducting rollers disposed above the winding core and a respective one of two guide rollers fixed with respect to the stand as well as a respective jockey roller which is suspended in a loop of the belt and extends or decreases the loop. In this way one ensures that the conveyor belts supplying the overlapping superposed sacks to be coiled and driving the storage reel that is being formed will pass thereabout by an angle of at least 90° so that the conveyor belts simultaneously act as pressure belts ensuring tight coiling of the storage reel.

Preferably, pressure paths are provided on the conveyors that feed the sacks in the longitudinal direction, these pressure paths pressing the sacks as flat as possible so that they assume little space and as many sacks as possible can be wound on a storage reel.

Further, the transporting device which guides the sacks to the conveyors branched off at right-angles can be extended beyond the last deflector and terminate in a depositing and packaging station. This makes it possible to collect the manufactured sacks in individual stacks in conventional manner and to stack same on palletes so that conventional pallete packages can also be produced.

Further advantageous constructions according to the invention are described in more detail in the subsidiary claims.

An example of the invention will now be described in more detail with reference to the drawing, in which:-

Figure 1:
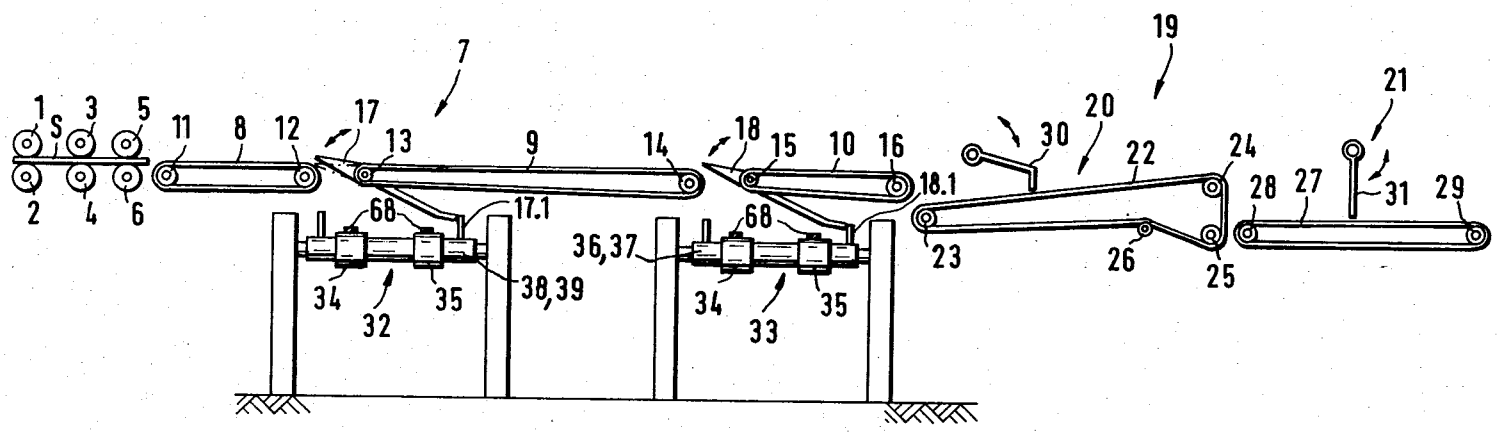
FIG. 1 is a diagrammatic side elevation of the conveyors leading to the winding devices.
Figure 2:
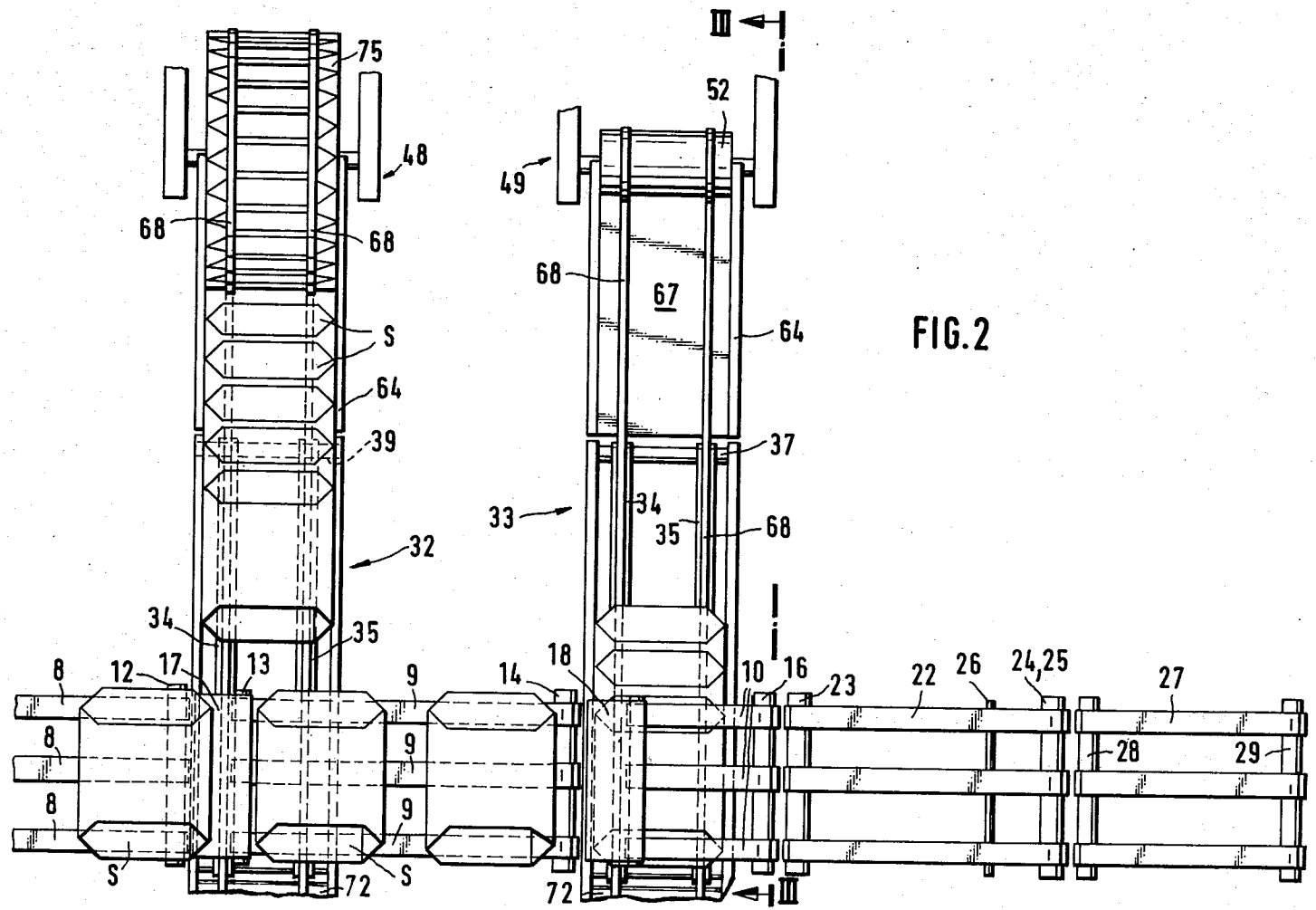
FIG. 2 is a diagrammatic plan view of the winding devices with the conveyors leading thereto.
Figure 3:
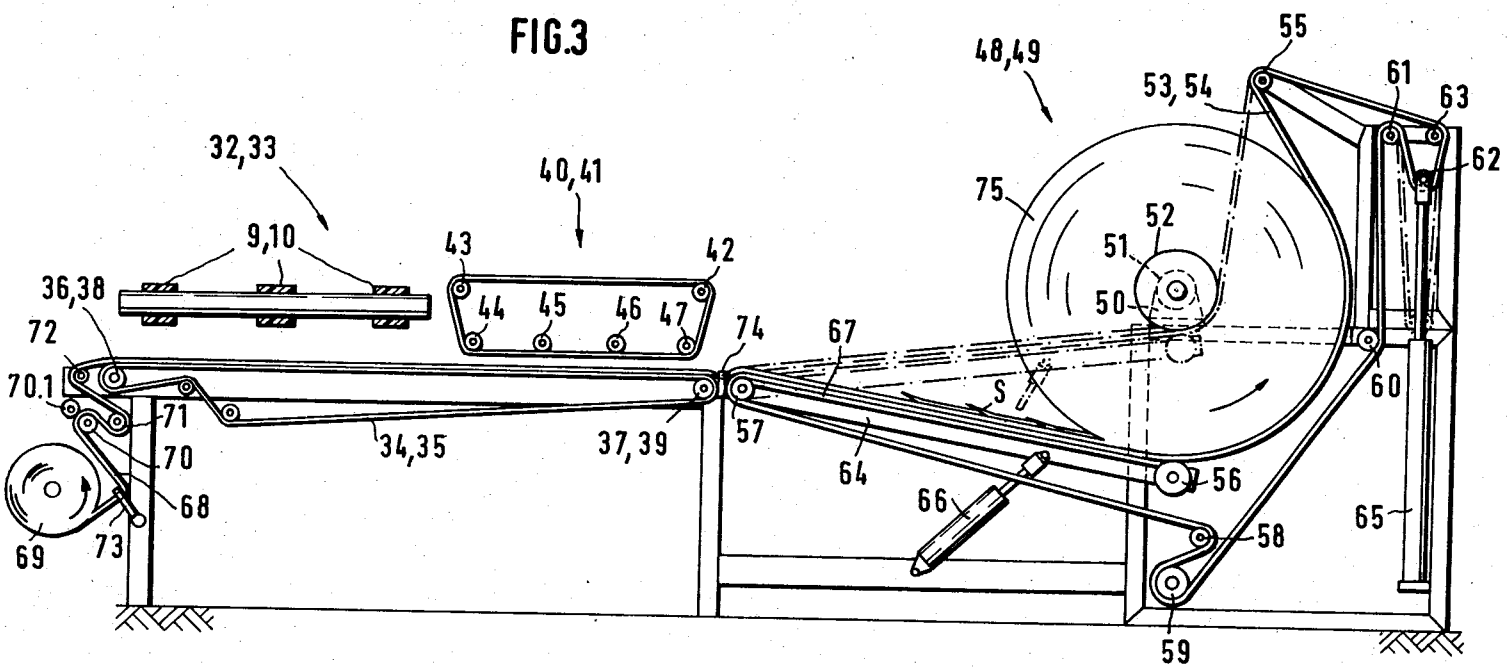
FIG. 3 is a section on the line III—III in FIG. 2.

According to FIG. 1, sacks S are withdrawn in a transverse position from a base-forming device (not shown) of a production machine from the left-hand side by pairs of tension rollers 1, 2; 3, 4; 5, 6 and fed to a conveyor 7. The latter consists of belts 8 to 10 which run over rollers 11 to 16 at the same speed as the base-forming device. Between the rollers 12, 13 and 14, 15 there are deflectors 17 and 18, respectively, which can be actuated when necessary and deflect the arriving sacks downwardly.

Behind the conveyor 7 there is a depositing and packaging station 19 formed by a device 20 for producing an overlapping relationship and a package-forming device 21. The device 20 for forming an overlapping relationship consists of belts 22 guided by rollers 23 to 26, the roller 23 lying somewhat lower than the roller 16, and the package-forming device consists of belts 27 passed over rollers 28 and 29. Above each of the belts 22 and 27 there is a movable abutment 30 and 31, respectively. The belts 22 move more slowly than the belts 10 so that a sack flung from the belts 10 onto the belts 22 will partially lie on the preceding sack that is already located on the belts 22, whereby an overlapping formation of sacks is formed on the belts 22. By means of the movable abutment 30, the overlapping formation can be stopped when this is lowered onto the belts 22. The overlapping formation of sacks finally arrives on the belts 27 and is here held back at the abutment 31 to form a package of sacks. This package is conveyed further by the belts 27 after the abutment 31 has been swung away. The packages can be stacked on palletes in known manner.

Beneath the deflectors 17, 18 or the belts 9, 10, conveyors 32, 33 are arranged at right-angles to the conveyor 7; they consist of belts 34, 35 passed over rollers 36, 37 and 38, 39, respectively and their lower runs pass over further rollers in the form of tensioning rollers. Lateral abutments 17.1 and 18.1 are positioned between the deflectors 17 and 18 on the outside of belts 34, 35, respectively, to assist in the placement of articles on the belts. The belts 34, 35 run more slowly then the belts 9, 10 so that the sacks flung thereon are superposed in an offset relationship and, by reason of the change of direction through 90°, are no longer fed transversely but in a longitudinal position.

Pressure bands 40, 41 passing over rollers 42, to 47 are arranged above the belts 34, 35. Of these, the rollers 44 to 47 are resiliently mounted and the pressure belts 40, 41 press on the sacks passed through by the belts 34, 35 so that the sacks lie flat.

Winding stations 48, 49 adjoin the conveyors 32, 33. Each of these winding stations 48, 49 comprises plummer blocks 50 with removable bearing covers 51, in which the shafts of winding cores 52 are inserted and in which they can turn loosely. The winding cores 52 or the storage reel 75 have preferably two juxtaposed pressure belts 53, 54 slung around them by about a quarter of their periphery, the pressure belts being guided over conducting rollers 55 to 63, the conducting rollers 61 to 63 forming part of a belt tensioning device. The conducting roller 56 is rotatably mounted on a rocker 64 of which the pivotal axis coincides with the rotary axis of the conducting roller 57. The conducting rollers 55, 57 to 61 and 63 are rotatably mounted in the stand of the winding station. The two ends of the shaft of the conducting rollers 62 are loosely rotatably connected to the piston rods of piston-cylinder pressure medium units 65. By subjecting the pistons of the piston-cylinder pressure medium units 65 to the pressure medium, shortening and lengthening of the pressure belts 53, 54 can be balanced out and they can be held under a constant tension. The conducting roller 59 is connected is a drive motor (not shown) and has the pressure belts 53, 54 slung about a large proportion of its periphery so that it acts as a drive roller and can set the belts in motion when the drive motor is in operation. By means of the rocker 64 on the one hand and the stand on the other hand, the ends of a piston-cylinder pressure medium unit 66 are pivotally connected, the unit pressing the conducting roller 56 onto the periphery of the winding core 52 or the storage reel 75. The sacks S arriving in the longitudinal position by way of the conveyors 32 or 33 reach the pressure belts 53, 54 between the rollers 56, 57, the pressure belts being held in this region against sagging by means of a connecting plate 67 connected to the rocker 64, and the sacks are wound on the winding core 52 by means of the pressure belts 53, 54.

At the same time, holding tapes 68 are wound up together with the sacks, the leading ends of the tapes being secured to the winding core 52. The holding tapes 68 lie on the pressure belts 53, 54 and are guided by storage rollers 69 over conducting or tensioning rollers 70 to 72 as well as the conducting rollers 36 or 38 and 37 or 39, respectively. A diverting plate 73 for the holding tapes 68 is disposed between the storage roller 69 and the conducting or tensioning roller 70; it contains holes through which the holding tapes 68 are pulled and it is set at such an angle to the rollers 69, 70 that the holding tape 68 is deflected at a sharp angle. By means of the sharp deflecting angle, the conducting roller 70 is enveloped through a large peripheral angle. A backing roller 70.1 is pressed against the conducting roller 70 and is connected with one half of an adjustable friction clutch, the other half being secured to the stand. The holding tape 68 is braked by the rollers 70 and 70.1, so that, when the winding core 52 stops to rotate and the holding tape 68 therefore discontinues to advance, the storage roller 69 can continue to move by a short distance without losing the tension applied to the holding tape 68 between the conducting roller 70 and the storage roller 75.

Guide plates 74 with a vertically disposed cross-section are arranged between the rollers 37 or 39 and 57 to hold down the holding tapes 68, their upper edges lying at a lower level then the upper edges of the rollers 37 or 39 and 57 and containing holes through which the holding tapes 68 pass. The holding tapes 68 are thereby compelled to move downwardly through a certain angle about the rollers 37, 39; they pass through the holes in the guide plates 74 and then move upwardly to lie intimately against the surface of the guide roller 57. The guide plates 74 make it advantageously possible for the rocker 64 to assume a horizontal means position. With a maximum diameter of the overlapping sacks wound to form one supply reel 75, the rocker 64 is inclined downwardly and at the beginning, when the conducting roller 56 lies against the winding core 52, the rocker is inclined upwardly by about the same angle. In this upwardly directed position of the rocker 64, the holding tape 68 would lift off the conducting roller 57 and the arriving overlapping formation of sacks would fail to be guided. By means of the mean horizontal position of the rocker 64, the sacks to be wound are not, or only to a slight extent, deflected downwardly or upwardly, so that the overlapping formation of sacks is hardly impeded during its passage.

After filling one storage reel 75 overlapping sacks, the deflectors 17 and 18 are switched over so that the sacks are diverted to the other winding station on which an empty winding core 52 is inserted in the bearing 50, 51 and at which the holding tapes 68 are connected to the winding core 52.

Desirably, one waits until the last sacks lying on the conveyor 32 or 33 have been wound onto the storage reel 75 and the drive for the conducting roller 59 is switched off only after the holding tapes 68 have been wound by two further empty convolutions around the storage reel 75. The tapes are then manually secured to the storage reel 75 by means of adhesive tape. Finally, the holding tapes 68 are severed behind the point of adhesion and the storage reel 75 is exchanged for a new winding core 52 to which the leading ends of the holding tapes coming from the storage reel 69 can be connected.

We claim:

1. In an apparatus for storing sacks, bags or like flat articles discharged at a high rate from a production machine, comprising a conveyor for feeding the articles to a station which combines them to form units containing larger numbers, the improvement comprising:

two deflectors disposed on the conveyor behind one another in the conveying direction;

a slower further conveyor below each of said two deflectors disposed at right-angles to the conveyor for feeding the articles;

abutments displaced near each of said deflectors and extending parallel to the edges of each of the slower further conveyors;

frames carrying rollers associated with and adjoining the downstream ends of the slower further conveyors and being pivotable about the axis of the roller closest the downstream end of the associated slower further conveyor;

a machine stand;

a winding core freely rotatably mounted in the machine stand;

an endless driven conveyor belt supported by said frame and passing over the rollers and each frame in such manner that articles carried by the endless driven conveyor belt are applied to the winding core to form an overlapping band reel from the articles supplied in overlapping formation by the associated slower further conveyor, the endless driven conveyor belt driving the overlapping band reel; and a roller with holding tape, the holding tape extending beneath the articles guided on the frame with the leading end of the holding tape being secured on the winding core.

2. In an apparatus as claimed in claim 1 the improvement further comprising belt tensioning means associated with each endless driven conveyor belt and having two rollers fixedly mounted to the machine stand, a moveable roller mounted for movement towards and away from the two rollers, and piston means for controlling movement of the moveable roller, the endless driven conveyor belt passing through the belt tensioning means in such manner that a belt loop is formed around the moveable roller, the size of the belt loop being varied by the movement of said moveable roller by said piston means.

3. In an apparatus as claimed in claim 1, the improvement further comprising a conducting roller and a backing roller positioned between each roller with holding tape and each of the slower further conveyors, the conducting roller and the backing roller being pressed together and having a gap therebetween for passage of the holding tape.

4. In an apparatus according to claim 1, the improvement further comprising pressure bands operatively associated with the slower further conveyors for applying pressure to articles carried on the slower further conveyors

5. In an apparatus according to claim 1, the improvement wherein said conveyor for feeding the articles is adapted to extend beyond the last of said two deflectors to terminate in a depositing and packaging station.

6. In an apparatus according to claim 1, the improvement wherein each of the frames carrying rollers is in the form of a rocker which is adapted to be pressed against the overlapping band and wherein the apparatus further comprises a piston-cylinder pressure medium unit for pressing the rocker against the overlapping band real.

7. In an apparatus according to claim 1, the improvement further comprising a guide plate positioned between each of the slower further conveyors and the frames carrying rollers for guiding the holding tapes.

* * * * *